US009251678B1

(12) United States Patent
Baumann et al.

(10) Patent No.: US 9,251,678 B1
(45) Date of Patent: Feb. 2, 2016

(54) SECURITY SYSTEM

(71) Applicant: Sandia Corporation, Albuquerque, NM (US)

(72) Inventors: Mark J. Baumann, Albuquerque, NM (US); Michal Kuca, Albuquerque, NM (US); Mona L. Aragon, Bernalillo, NM (US)

(73) Assignee: Sandia Corporation, Albuquerque, NM (US)

( * ) Notice: Subject to any disclaimer, the term of this patent is extended or adjusted under 35 U.S.C. 154(b) by 44 days.

(21) Appl. No.: 14/053,217

(22) Filed: Oct. 14, 2013

Related U.S. Application Data

(60) Provisional application No. 61/724,663, filed on Nov. 9, 2012.

(51) Int. Cl.
*G08B 13/00* (2006.01)
*G08B 13/12* (2006.01)
*G08B 13/08* (2006.01)

(52) U.S. Cl.
CPC ..... *G08B 13/12* (2013.01); *G08B 13/08* (2013.01)

(58) Field of Classification Search
CPC .... G08B 13/12; G08B 13/122; G08B 13/124; G08B 13/126; G08B 13/08; E05B 65/0075; E05B 43/00; E05B 17/22; A61J 7/0418; A61J 2205/60; A61J 1/16; Y10T 70/7068; G06F 19/3462; G07C 1/32
USPC ..... 340/540, 541, 545.6, 545.2, 545.3, 340/545.1, 568.1; 250/227.1, 227.16, 250/227.14, 227.15; 70/266, 267, 278.1, 70/231
See application file for complete search history.

(56) References Cited

U.S. PATENT DOCUMENTS

| | | | | |
|---|---|---|---|---|
| 6,556,138 | B1 * | 4/2003 | Sliva et al. | 340/568.1 |
| 7,482,924 | B1 | 1/2009 | Beinhocker | |
| 8,339,261 | B1 * | 12/2012 | Wolski | 340/545.6 |
| 8,344,885 | B2 * | 1/2013 | Smith | 340/550 |
| 8,531,292 | B2 * | 9/2013 | Dagher et al. | 340/541 |
| 2009/0115607 | A1 * | 5/2009 | Beinhocker | 340/541 |

* cited by examiner

*Primary Examiner* — Anh V La
(74) *Attorney, Agent, or Firm* — Daniel J. Jenkins

(57) ABSTRACT

A security system includes a structure having a structural surface. The structure is sized to contain an asset therein and configured to provide a forceful breaching delay. The structure has an opening formed therein to permit predetermined access to the asset contained within the structure. The structure includes intrusion detection features within or associated with the structure that are activated in response to at least a partial breach of the structure.

19 Claims, 2 Drawing Sheets

SECURITY SYSTEM

CROSS-REFERENCE TO RELATED APPLICATIONS

This application claims the benefit of U.S. Provisional Patent Application No. 61/724,663, entitled "Security System," filed Nov. 9, 2012, which is incorporated herein by reference in its entirety.

STATEMENT REGARDING FEDERALLY SPONSORED RESEARCH OR DEVELOPMENT

This invention was developed under Contract DE-AC04-94AL85000 between Sandia Corporation and the U.S. Department of Energy. The U.S. Government has certain rights in this invention.

FIELD OF THE DISCLOSURE

The present disclosure relates to security systems. More specifically, the present disclosure relates to security systems permitting a predetermined access to an asset protected by the security systems.

BACKGROUND OF THE DISCLOSURE

Valuable assets typically require security systems for their protection. If the asset is a work of art, for example, a security system that prevents access to the asset would be sufficient, and the list of individuals authorized to access the asset could be limited to a minimum number of individuals.

However, assets that require continuous access present special challenges. One such type of asset includes specialized instruments for sterilizing a product, requiring access to the asset in order to insert the product into the asset for sterilization of the product, access to a control panel of the asset to instruct the asset to sterilize the product, and access to the asset in order to remove the product from the asset. Additional access to the asset could also include access for purposes of calibrating the asset, such as could be performed via access to the control panel of the asset. Due to the large number of individuals that may continuously require use of such an asset, monitoring and maintenance of individuals having conventional "full" access to the asset would significantly increase both the complexity and cost associated with a security system for the asset.

Therefore, there is a need for a security system that accommodates limited access to the asset, as described above, without requiring the same level of authorization/monitoring as would be required for "full" access. In combination with a significantly increased access to the asset, there is a need for a security system that additionally has enhanced intrusion detection features, as well as a forcible delay system that provides enhanced protection of the asset.

SUMMARY OF THE DISCLOSURE

According to an embodiment, a security system includes a structure having a structural surface, the structure sized to contain an asset therein and configured to provide a forceful breaching delay. The structure has an opening formed therein to permit predetermined access to the asset contained within the structure. The structure includes intrusion detection features within or associated with the structure that are activated in response to at least a partial breach of the structure.

According to another embodiment, a security system includes a structure including a plurality of interconnected structural members. The structure has a structural surface and is sized to contain an asset therein and configured to provide a forceful breaching delay. The structure has an opening formed therein to permit predetermined access to the asset contained within the structure. The structure includes intrusion detection features within or associated with the structure. The intrusion detection features include a strand of flexible material extending along or within at least a portion of the interconnected structural members and received by an interface component. Sufficient damage to the strand as sensed by the interface component results in generation of an alarm signal corresponding to at least a partial breach of the structure.

According to yet another embodiment, a method of using a protected asset includes enclosing the asset and a structure. A structure has a structural surface. The structure is sized to contain an asset therein and configured to provide a forceful breaching delay. The structure has an opening formed therein to permit predetermined access to the asset contained within the structure. The structure includes intrusion detection features within or associated with the structure that are activated in response to at least a partial breach of the structure. The method further includes accessing the asset through the opening.

An advantage of the present disclosure is a security system providing access to a protected asset without opening its protective structure.

Another advantage of the present disclosure is a security system providing a forceful breaching delay as well as an alarm system that is activated in response to at least a partial breach of the structure.

Further aspects of the method and system are disclosed herein. The features as discussed above, as well as other features and advantages of the present disclosure will be appreciated and understood by those skilled in the art from the following detailed description and drawings.

BRIEF DESCRIPTION OF THE DRAWINGS

Wherever possible, the same reference numbers will be used throughout the drawings to represent the same parts.

DESCRIPTION OF THE DISCLOSURE

Figure 1:
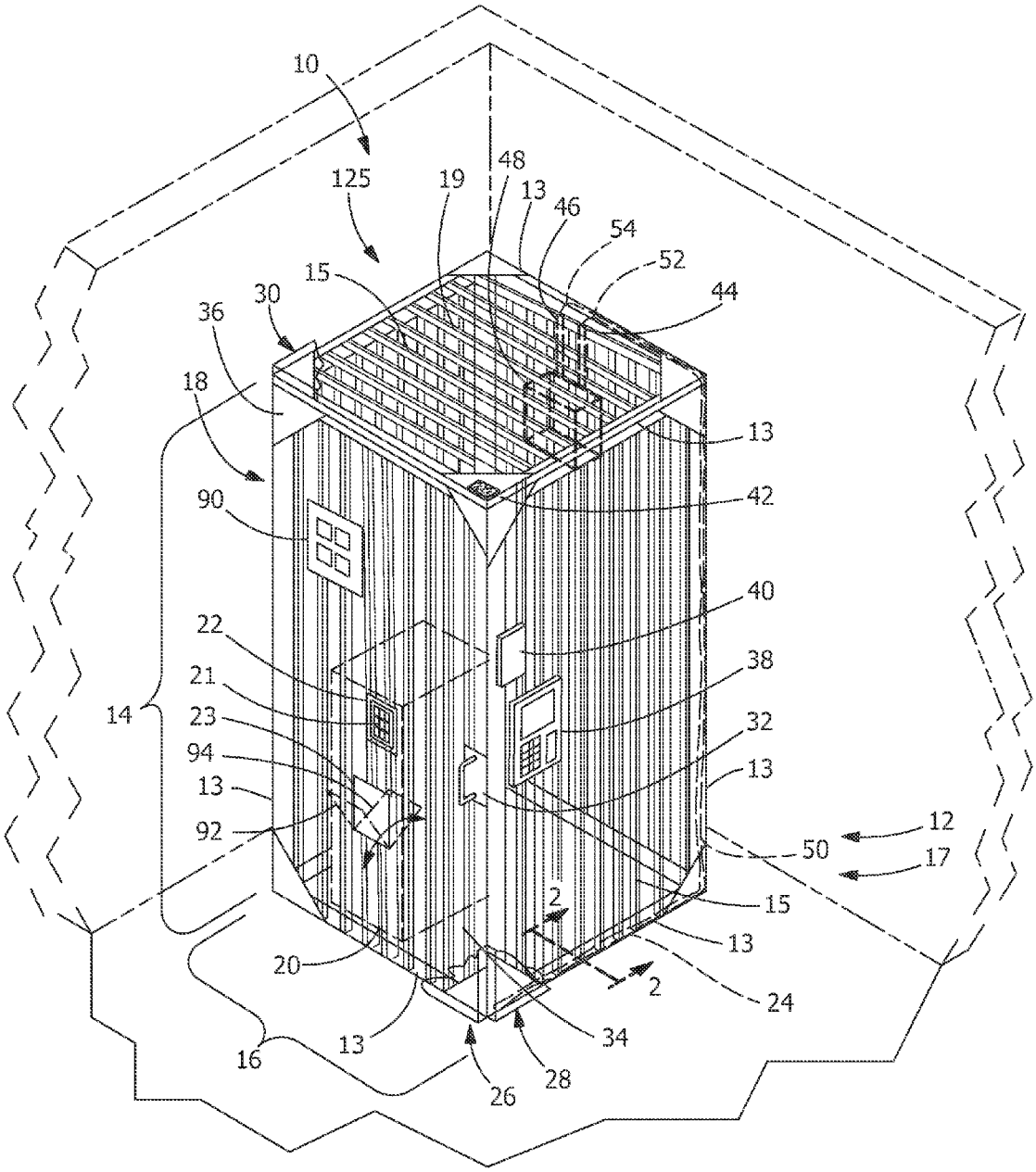
FIG. 1 illustrates an upper perspective view of an exemplary embodiment of a security system.

FIG. 1 shows an upper perspective view of a security system 10 of the present disclosure. Security system 10 includes an enclosure, such as a cage or structure 12. As further shown in FIG. 1, structure 12 has a cubical profile, including interconnected edge members 13 with intermediate structural members 15 extending between opposed edge members 13 at a predetermined spacing from each other. In another embodiment, the predetermined spacing between intermediate structural members 15 may vary, e.g., between different portions of structure 12, if desired. Collectively, structure 12 comprises interconnected edge members 13 and intermediate structural members 15 defining interconnected structural members 17. As further shown in FIG. 1, structure 12 may optionally include corner stiffeners 36 to add further rigidity and strength. Structure 12 is provided to achieve a forceful breaching delay of a protected asset 20. That is, structure 12 is comprised of structural members of sufficient structural integrity to prevent unauthorized access of asset 20 for a period of time deemed sufficient for security personnel to intervene to prevent theft or otherwise unauthorized removal of asset 20 from structure 12 as well as preventing tampering with asset 20. It is to be understood that in another embodiment, structure 12 may resemble any geometric profile capable of securing and providing access to a desired asset 20 positioned within or inside of the structure, including curved edge members 13, if desired or appropriate.

To gain unrestricted access of asset 20 without breaching intrusion detection features 24 (to be discussed in greater detail below) upon entering the correct sequence of characters in control panel 38, an electronic closure device 40, such as an electric strike plate or dead bolt is urged to an open position, permitting door 34 of structure 12 to open. As further shown in FIG. 1, an additional feature of security system 10 includes a balance magnetic switch 42, which activates an alarm in case door 34 is opened or otherwise achieves an open position without entering the correct sequence of characters in control panel 38 that is normally required for door 34 to be opened.

As further shown in FIG. 1, structure 12 includes a novel access feature permitting a predetermined degree or extent of access of asset 20 without requiring unrestricted access (i.e., inputting the correct sequence of characters or "combination" of control panel 38 required to open door 34 of structure 12). That is, as shown in FIG. 1, an opening 22 is formed in door 34 corresponding to controls 21 of asset 20. As further shown in FIG. 1, opening 23 is formed in door 34, permitting a product (not shown) to be placed in a corresponding compartment of asset 20. In each instance, access via openings 22, 23 may be achieved without opening door 34 of structure 12. It is to be understood that a single opening or more than two openings may be formed in structure 12 to provide an amount or extent of access of asset 20 required for proper interaction with or control of asset 20. However, irrespective of the number of openings formed in structure 12 for purposes of access of asset 20, the openings, singly or collectively, are insufficient to permit removal of asset 20 from structure 12 without door 34 of structure 12 being opened. In another embodiment, the access permitted would be at least partially indirect access. As further shown FIG. 1, an optional control panel 90 that is hard-wired or operatively connected to asset 20 via a wireless arrangement, may be used to control asset 20. Alternately, or additionally, a receptacle 92 having a compartment 94 may be movably secured in opening 23. Receptacle 92 may be manually actuated or controllably actuated by control panel 90 into movement, such as a rotational movement 96 in one direction to urge receptacle 92 to an open position to receive a product (not shown) in compartment 94. Once the product has been placed in compartment 94 of receptacle 92, actuation of receptacle 92 such as by rotational movement 96 in an opposite direction urges receptacle 92 to a closed position. Once receptacle 92 is returned to the closed position, the product may be presented to asset 20 for testing, in which asset 20 retrieves the product or the product is introduced into asset 20, such as by gravity. Once the product has been sterilized or otherwise processed, the product is then returned to compartment 94 for retrieval by actuating receptacle 92 to the open position.

Figure 2:
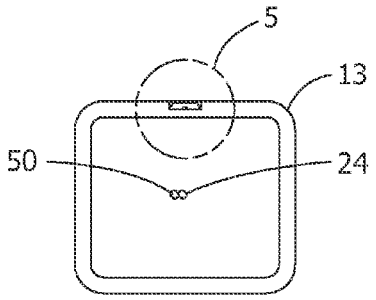
FIG. 2 illustrates a cross section taken along line 2-2 of FIG. 1 of an embodiment of a structure of a security system.

As further shown collectively in FIGS. 1-2, intrusion detection feature 24, which is one of several intrusion detection features of the present disclosure, is now discussed. Intrusion detection feature 24 includes a strand 50 of a flexible material such as a wire or a fiber-optic fiber or other suitable material that may be used to detect intrusion or unauthorized access of structure 12. As further shown in FIG. 1, at least one strand 50, shown as a loop or one pair of strands 50 in FIG. 2 (which is a cross section taken along line 2-2 of FIG. 1), extending continuously through edge member 13 positioned below control panel 38, through a corner, then through a vertically oriented edge member 13, and extending partially through an edge member 13 positioned along the top of structure 12. At this point, ends 52, 54 of pair of strands 50 are fed into respective conduits 44, 46, terminating in interface component 48.

In one embodiment, in which the pair of strands 50 are fiber-optic fibers, interface component 48 includes an illumination portion, such as a LASER light that is transmitted through the corresponding fibers entering the interface component from conduit 44. Interface component 48 further includes a signal processing unit (not shown) associated with corresponding fibers entering interface component from conduit 46. If the light transmitted from end 52 to end 54 of strands 50 is breached, such as by severing or infliction of sufficient damage upon strands 50, a signal processing unit (not shown) associated with interface component 48 will enunciate the attempted intrusion, also referred to as at least a partial breach of the structure, such as by transmitting or generating an alarm signal as is well known. In order to provide enhanced intrusion detection of structure 12, at least one strand 50 extends through each of edge members 13 and into interface component 48 in a similar manner as previously discussed.

It is appreciated that directing strands 50 through edge members 13 may be desirable, as strands 50 are protected from inadvertent damage or from tampering.

Figure 5:
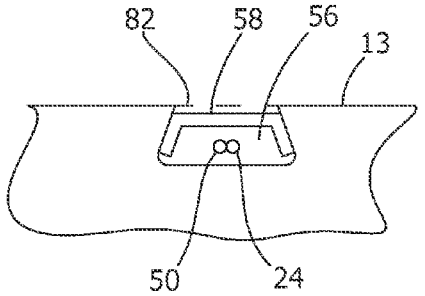
FIG. 5 illustrates an enlarged, partial view taken from region 5 of FIG. 2 of an embodiment of a structure of a security system.

As further shown collectively in FIGS. 2 and 5, an alternate embodiment for directing strands 50 is discussed. That is, instead of directing strands 50 inside of edge members 13 (FIG. 2) as previously discussed, a groove or slot 56 may be formed in a surface of one side of edge member 13, permitting installation of strands 50 from exterior of edge member 13. In order to secure strands 50 in slot 56, a retainer 58 may be utilized. As further shown in FIG. 5, which is a cross section taken along line 2-2 of FIG. 1, opposed sides of slot 56 may be tapered, and retainer 58 may be seated in a position that is substantially flush with or recessed or below surface 82 of edge member 13. In addition retainer 58 may be comprised of a metal or a nonmetal, if desired.

Figure 3:
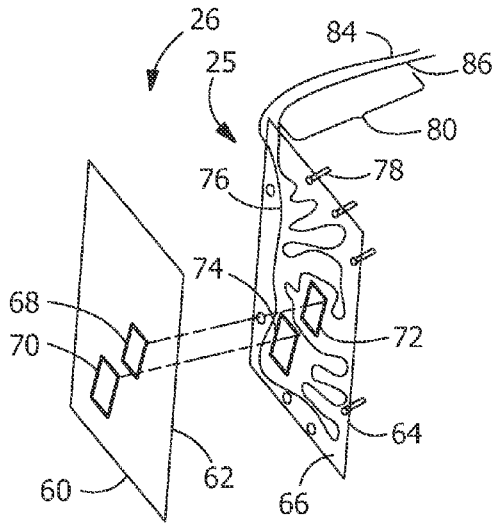
FIG. 3 illustrates an exploded upper perspective view of an exemplary embodiment of a panel assembly.

As further shown collectively in FIGS. 1 and 3, an additional intrusion detection feature 25 is now discussed. Intrusion detection feature 25 includes a panel assembly 26 that is sized to substantially cover a surface 18 of structure 12 having a surface area that is the product of height 14 and width 16 of structure 12. As further shown in FIG. 1, panel assemblies 28, 30 correspond to and substantially cover different surfaces of structure 12. Although only three panel assemblies are shown or identified in FIG. 1, in another embodiment, each surface of an enclosure, such as six surfaces of structure 12 of FIG. 1 may be employed.

As further shown collectively in FIGS. 1 and 3, panel assembly 26 includes a first panel portion 60 having a first surface 62 and a second panel portion 64 having a second surface 66. As further shown in FIG. 3, an opening 68 is formed in first panel portion 60 and a corresponding opening 72 is formed in second panel portion 64. Similarly, an opening 70 is formed in first panel portion 60 and a corresponding opening 74 is formed in second panel portion 64. During assembly of panel assembly 26, in which first surface 62 is brought into close proximity with second surface 66 and joined to each other, opening 68 is aligned with opening 72 and opening 70 is aligned with opening 74.

However, prior to assembly, a strand 76 of flexible material such as a wire or a fiber-optic fiber, as previously discussed, is arranged between first surface 62 of first panel portion 60 and second surface 66 of second panel portion 64. As further shown in FIG. 3, the arrangement of strand 76 may be a random arrangement, or in another embodiment may be a predetermined arrangement, e.g., such as a patterned arrangement. The arrangement of strand 76 may not extend over any of openings 68, 72, 70, 74, or any openings in which fasteners, such as a fastener 78 for securing the assembled panel assembly 26 to the structure 12 (FIG. 1) or fasteners for securing door handle 32 (FIG. 1) to structure 12 or other components to be secured to structure 12 may be installed. In one embodiment, to assist in arranging strand 76, at least one of first surface 62 and/or second surface 66 may include an adhesive layer.

In order to connect strand 76 to interface component 48 (FIG. 1), as further shown in FIG. 3, a predetermined length 80 of strand 76 terminating in opposed ends 84, 86 extends exterior of the assembled panel assembly 26. Although shown in FIG. 3 as extending from a corner of panel assembly 26, predetermined length 80 may extend from other locations of the panel assembly. In another embodiment, multiple predetermined lengths 80 may extend from panel assembly 26, if desired, and may define either an arrangement of strand 76 that is independent of the first arrangement of strand 76, or a portion of the same arrangement of strand 76. Upon panel assembly 26 being assembled to structure 12, such as by fasteners 78, the predetermined length 80 is routed within and/or along at least a portion of interconnected structural members 17 of structure 12 prior to connection with interface component 48 in a manner as previously discussed.

As shown collectively in FIGS. 1 and 3, panel assembly 26 has been secured to door 34 of structure 12. The aligned openings 68, 72 of panel assembly 26 are aligned with opening 22 formed in door 34. Similarly, the aligned openings 70, 74 of panel assembly 26 are aligned with opening 23 formed in door 34. As a result of the aligned openings collectively formed in panel assembly 26 and door 34, a predetermined access to asset 20 is provided without requiring door 34 to be opened. As a result of such predetermined access, security procedures can be significantly simplified, as those individuals requiring only the predetermined access to asset 20 would require a lower level of security access, not the "full" access involving opening a door 34 of structure 12 (requiring the password or correct keypunch sequence to be entered into control panel 38).

Figure 4:
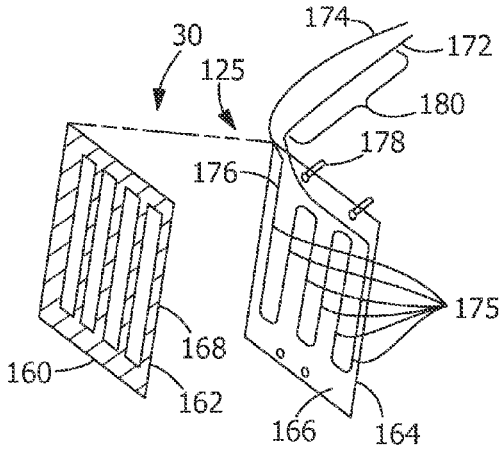
FIG. 4 illustrates an exploded upper perspective view of an exemplary embodiment of a panel assembly.

As shown collectively in FIGS. 1 and 4, an additional intrusion detection feature 125 is now discussed. As further shown in FIG. 1, detection feature 125 includes a panel assembly 30 that is sized to substantially cover a surface 19 of structure 12 associated with the top of the structure.

As further shown collectively in FIGS. 1 and 4, panel assembly 30 includes a first panel portion 160 having a first surface 162, with first surface 162 including a treated area 168. Panel assembly 30 further includes a second panel portion 164 having a second surface 166. Although panel assembly 30 as shown in FIG. 4 does not include openings formed in panel portions 160, 164 in contrast to panel assembly 26, such openings may be formed in the panel portions as needed. As further shown in FIG. 4, prior to assembly of first portion 160 to second panel portion 164, a strand 176 of flexible material such as a wire or a fiber-optic fiber, as previously discussed relative to panel assembly 26, is arranged between first surface 162 of first panel portion 160 and second surface 166 of second panel portion 164.

As further shown in FIG. 4, the arrangement of strand 176 is a predetermined arrangement in which strand portions 175 are in alignment with corresponding interconnected structural members 17 of structure 12 upon the assembly of panel assembly 30 over surface 19 of structure 12. With strand portions 175 in an aligned arrangement, treated area 168 of first surface 162 of first panel portion 160 may be rendered opaque in regions that align with interconnected structural members 17 in order to conceal strand portions 175, while providing an observer located exterior of structure 12 the ability to visually perceive the interior volume of structure 12. In another embodiment, at least a portion of one or more of first panel portion 160 and/or second panel portion 164 may be rendered substantially transparent, substantially translucent, or substantially opaque. That is, any portion of the panel assemblies of the present disclosure may be selectably treated so as to provide the desired ability by an observer to view any portion of the interior volume of structure 12 through the panel assemblies, as well as any portion of the panel assemblies themselves. The panel assembly portions can be comprised of metal, a non-metal, such as a polycarbonate, or any suitable material or combination thereof.

In one embodiment, to assist in arranging strand 176, at least one of first surface 162 and/or second surface 166 may include an adhesive layer. In order to connect strand 176 to interface component 48 (FIG. 1), as further shown in FIG. 4, a predetermined length 180 of strand 176 terminating in opposed ends 172, 174 extends exterior of the assembled panel assembly 30. Upon panel assembly 30 being assembled to structure 12, such as by fasteners 178, the predetermined length 180 is routed within and/or along at least a portion of interconnected structural members 17 of structure 12 prior to connection with interface component 48 in a manner as previously discussed.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A security system comprising:

a structure having a structural surface, the structure sized to contain an asset therein and configured to provide a forceful breaching delay;

the structure having an opening formed therein to permit predetermined access to the asset contained within the structure; and the structure including intrusion detection features within or associated with the structure that are activated in response to at least a partial breach of the structure;

wherein the structure comprises interconnected structural members; and wherein the intrusion detection features include a strand of flexible material extending within at least one interconnected edge member, opposed ends of the strand received by an interface component; sufficient damage to the strand as sensed by the interface component resulting in generation of an alarm signal corresponding to at least a partial breach of the structure; and wherein the at least one interconnected edge member at least partially defines at least one interconnected structural member comprising an opening.

2. The security system of claim 1, wherein the strand comprises a fiber-optic fiber.

3. The security system of claim 1, wherein the intrusion detection features include at least one panel assembly substantially covering the structural surface, the panel assembly having an opening substantially aligned with the opening formed in the structure.

4. The security system of claim 3, wherein the panel assembly includes a first panel portion having a first surface and a second panel portion having a second surface, an arrangement of a strand of flexible material is provided between the first surface and the second surface prior to assembly of the first panel portion to the second panel portion.

5. The security system of claim 4, wherein predetermined lengths of the strand terminating at opposed ends of the strand sufficiently extending exterior of the assembled panel assembly, permitting the predetermined lengths of the strand to extend along or within at least a portion of the interconnected structural members with the opposed ends of the strand received by an interface component; sufficient damage to the strand as sensed by the interface component resulting in generation of an alarm signal corresponding to at least a partial breech of the structure.

6. The security system of claim 4, wherein at least a portion of at least one of the first panel portion and the second panel portion are substantially transparent.

7. The security system of claim 4, wherein at least a portion of at least one of the first panel portion and the second panel portion are substantially translucent.

8. The security system of claim 4, wherein at least a portion of at least one of the first panel portion and the second panel portion are substantially opaque.

9. The security system of claim 4, wherein the first panel portion and the second panel portion are comprised of a non-metal.

10. The security system of claim 4, wherein the first panel portion and the second panel portion are comprised of a polycarbonate.

11. The security system of claim 4, wherein the arrangements of the strand of a flexible material substantially aligns with the plurality of interconnected structural members over which the panel assembly is installed.

12. The security system of claim 11, wherein at least a portion of the first surface of the first panel portion substantially aligning with the plurality of interconnected structural members is treated to substantially conceal the arrangement of the strand of flexible material.

13. A security system comprising:

a structure including a plurality of interconnected structural members defined at least by at least one interconnected edge member, the structure having a structural surface and sized to contain an asset therein and configured to provide a forceful breaching delay;

the structure having an opening formed therein to permit predetermined access to the asset contained within the structure;

the structure including intrusion detection features within or associated with the structure, the intrusion detection features including a strand of flexible material extending along or within at least a portion of the interconnected structural members and received by an interface component; and wherein sufficient damage to the strand as sensed by the interface component resulting in generation of an alarm signal corresponding to at least a partial breach of the structure; and wherein the at least one interconnected edge member at least partially defines at least one interconnected structural member comprising an opening.

14. The security system of claim 13, wherein the strand comprises a fiber-optic fiber.

15. The security system of claim 13, wherein the intrusion detection features include at least one panel assembly substantially covering the structural surface, the panel assembly having an opening substantially aligned with the opening formed in the structure.

16. The security system of claim 15, wherein the panel assembly includes a first panel portion having a first surface and a second panel portion having a second surface, an arrangement of a strand of flexible material provided between the first surface and the second surface prior to assembly of the first panel portion to the second panel portion.

17. The security system of claim 15, wherein predetermined lengths of the strand terminating at opposed ends of the strand sufficiently extending exterior of the assembled panel assembly, permitting the predetermined lengths of the strand to extend along or within at least a portion of the interconnected structural members with the opposed ends of the strand to be received by an interface component, sufficient damage to the strand as sensed by the interface component resulting in generation of an alarm signal corresponding to at least a partial breech of the structure.

18. The security system of claim 13, wherein the arrangements of the strand of the flexible material substantially aligns with the plurality of interconnected structural members over which the panel assembly is installed.

19. The security system of claim 18, wherein at least a portion of the first surface of the first panel portion substantially aligning with the plurality of interconnected structural members is treated to substantially conceal the arrangement of the strand of flexible material.

* * * * *